US008542621B2

(12) United States Patent
Park

(10) Patent No.: US 8,542,621 B2
(45) Date of Patent: Sep. 24, 2013

(54) METHOD OF AND APPARATUS FOR PROVIDING AND RECEIVING VIDEO SERVICE IN DIGITAL AUDIO BROADCASTING

(75) Inventor: Jeong-hoon Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1722 days.

(21) Appl. No.: 11/633,037

(22) Filed: Dec. 4, 2006

(65) Prior Publication Data

US 2007/0136780 A1 Jun. 14, 2007

(30) Foreign Application Priority Data

Dec. 10, 2005 (KR) ..... 10-2005-0121253

(51) Int. Cl.
*H04H 20/71* (2008.01)

(52) U.S. Cl.
USPC ..... 370/312; 370/328; 725/54; 725/118; 725/136

(58) Field of Classification Search
CPC . H04N 9/8042; H04N 9/8063; G11B 27/034; G11B 27/105; G11B 2220/2562
USPC ..... 370/312, 328, 395.1; 375/340; 725/54, 95, 118, 136
See application file for complete search history.

(56) References Cited

U.S. PATENT DOCUMENTS

| | | | | |
|---|---|---|---|---|
| 7,447,218 | B2 * | 11/2008 | Matsuda et al. | 370/401 |
| 2002/0045430 | A1 * | 4/2002 | Kamei | 455/186.2 |
| 2005/0055714 | A1 * | 3/2005 | Lee | 725/54 |
| 2005/0262419 | A1 * | 11/2005 | Becker et al. | 714/758 |
| 2005/0273829 | A1 * | 12/2005 | Oh | 725/100 |
| 2006/0002431 | A1 | 1/2006 | Seo et al. | |
| 2006/0262227 | A1 * | 11/2006 | Jeong | 348/723 |

FOREIGN PATENT DOCUMENTS

| | | | |
|---|---|---|---|
| CN | 1705257 | A | 12/2005 |
| EP | 0881792 | A2 | 12/1998 |
| EP | 1501222 | A2 | 1/2005 |
| EP | 1592160 | B1 | 3/2008 |
| JP | 10-327111 | A | 12/1998 |
| JP | 2005-333629 | A | 12/2005 |

OTHER PUBLICATIONS

ETSI EN 300-401 (Copyright Document), "Radio Broadcasting Systmes; Digital Audio Broadcasting (DAB) to mobile, portable and fixed receivers", May, 2001, V1.3.3.*
Chinese Office Action Dated Oct. 16, 2009 with English Translation.
Lee G., et al., "Development of Terrestrial DMB Transmission system based on Eureka-147 DAB System," IEEE Transactions on Consumer Electronics, vol. 51, No. 1, Feb. 2005, pp. 63-68.

(Continued)

*Primary Examiner* — Jung Park
(74) *Attorney, Agent, or Firm* — Sughrue Mion, PLLC

(57) ABSTRACT

Methods and apparatuses for providing and receiving a video service in digital audio broadcasting (DAB) are provided. The method includes inserting a profile ID (identifier) indicating an encoding method used for a provided video service stream and program type information indicating the type of the provided video service stream into a fast information channel (FIC) that is different from a service data channel and multiplexing service data channel including the video service stream and the FIC into a transmission frame for transmission.

42 Claims, 18 Drawing Sheets

(56) References Cited

OTHER PUBLICATIONS

Yun, J., et al., "Remultiplexing of Ensemble Transport Interface for Terrestrial DMB Service," ETRI Journal, vol. 27, No. 1, Feb. 2005, pp. 102-105.
Chinese Office Action issued in corresponding Chinese Application No. 200680042969.9 on Sep. 21, 2011.
Japanese Office Action issued in corresponding Japanese Application No. 2008-544260 on Aug. 23, 2011.
"Digital Audio Broadcasting (DAB); Guidelines and rules for implementation and operation; Part 1: System outline; ETSI TR 101 496-1", IEEE, LIS, Sophia Antipolis Cedex, France, vol. BC, No. V1.1.1, Nov. 1, 2000 XP014004879 , ISSN: 0000-0001.
"Digital Audio Broadcasting (DAB); DMB video service; User Application Specification European Broadcasting Union Union Européenne de Radio-Télévision EBUÜER; ETSI TS 102 428", IEEE, LIS, Sophia Antipolis Cedex, France, vol. BC, No. V1.1.1, Jan. 1, 2005, XP014030465, ISSN: 0000-0001.
Communication from the European Patent Office issued May 23, 2012 in counterpart European Application No. 06824011.8.
Alexandros Eleftheriadis et al: "MPEG-4 Systems ISO/IEC FCD 14496-1:1998", May 15, 1998, total 13 pages, XP55058252, Retrieved from the Internet: URL:http://jaadec.sourceforge.net/specs/ISO_14496-1_Systems.pdf [retrieved on Apr. 2, 2013].
Communication from the European Patent Office issued Apr. 11, 2013 in counterpart European Application No. 06824011.8.
Communication dated Apr. 2, 2013 from the State Intellectual Property Office of P.R. China in a counterpart application No. 200680042969.9.
Communication dated Jun. 27, 2013 issued by the State Intellectual Property Office of P.R. China in counterpart Chinese Patent Application No. 200680042969.9.

* cited by examiner

FIG. 14

Programme type codes and abbreviations in the English language, applying to all countries, except for North America

| Decimal Number | Code | | | | | Programme type | 16-character abbreviation | 8-character abbreviation |
|---|---|---|---|---|---|---|---|---|
| | $b_4$ | $b_3$ | $b_2$ | $b_1$ | $b_0$ | | | |
| 0 | 0 | 0 | 0 | 0 | 0 | No programme type | None | None |
| 1 | 0 | 0 | 0 | 0 | 1 | News | News | News |
| 2 | 0 | 0 | 0 | 1 | 0 | Current Affairs | Current_Affairs | Affairs |
| 3 | 0 | 0 | 0 | 1 | 1 | Information | Information | Info |
| 4 | 0 | 0 | 1 | 0 | 0 | Sport | Sport | Sport |
| 5 | 0 | 0 | 1 | 0 | 1 | Education | Education | Educate |
| 6 | 0 | 0 | 1 | 1 | 0 | Drama | Drama | Drama |
| 7 | 0 | 0 | 1 | 1 | 1 | Culture | Arts | Arts |
| 8 | 0 | 1 | 0 | 0 | 0 | Science | Science | Science |
| 9 | 0 | 1 | 0 | 0 | 1 | Varied | Talk | Talk |
| 10 | 0 | 1 | 0 | 1 | 0 | Pop Music | Pop_Music | Pop |
| 11 | 0 | 1 | 0 | 1 | 1 | Rock Music | Rock_Music | Rock |
| 12 | 0 | 1 | 1 | 0 | 0 | Easy Listening Music | Easy_Listening | Easy |
| 13 | 0 | 1 | 1 | 0 | 1 | Light Classical | Light_Classical | Classics |
| 14 | 0 | 1 | 1 | 1 | 0 | Serious Classical | Classical_Music | Classics |
| 15 | 0 | 1 | 1 | 1 | 1 | Other Music | Other_Music | Other_M |
| 16 | 1 | 0 | 0 | 0 | 0 | Weather/meteorology | Weather | Weather |
| 17 | 1 | 0 | 0 | 0 | 1 | Finance/Business | Finance | Finance |
| 18 | 1 | 0 | 0 | 1 | 0 | Children's programmes | Children's | Children |
| 19 | 1 | 0 | 0 | 1 | 1 | Social Affairs | Factual | Factual |
| 20 | 1 | 0 | 1 | 0 | 0 | Religion | Religion | Religion |
| 21 | 1 | 0 | 1 | 0 | 1 | Phone In | Phone_In | Phone_In |
| 22 | 1 | 0 | 1 | 1 | 0 | Travel | Travel | Travel |
| 23 | 1 | 0 | 1 | 1 | 0 | Leisure | Leisure | Leisure |
| 24 | 1 | 1 | 0 | 0 | 0 | Jazz Music | Jazz_and_Blues | Jazz |
| 25 | 1 | 1 | 0 | 0 | 1 | Country Music | Country_Music | Country |
| 26 | 1 | 1 | 0 | 1 | 0 | National Music | National_Music | Nation_M |
| 27 | 1 | 1 | 0 | 1 | 1 | Oldies Music | Oldies_Music | Oldies |
| 28 | 1 | 1 | 1 | 0 | 0 | Folk Music | Folk_Music | Folk |
| 29 | 1 | 1 | 1 | 0 | 1 | Documentary | Documentary | Document |
| 30 | 1 | 1 | 1 | 1 | 0 | *Not used* | | |
| 31 | 1 | 1 | 1 | 1 | 1 | *Not used* | | |

NOTE 1: This table forms part 1 of the International Table Identifier /0000 0001/ (see clause 5.7) which references the PTy codes for DAB use, except in North America.

NOTE 2: The notation _ is used to indicate the use of the "space" character.

FIG. 19

| PROFILE ID | MAIN CONTENTS INFORMATION | RESERVED |
|---|---|---|
| 1 BYTE | 1 BIT | |

METHOD OF AND APPARATUS FOR PROVIDING AND RECEIVING VIDEO SERVICE IN DIGITAL AUDIO BROADCASTING

CROSS-REFERENCE TO RELATED PATENT APPLICATION

This application claims priority from Korean Patent Application No. 10-2005-0121253, filed on Dec. 10, 2005 in the Korean Intellectual Property Office, the disclosure of which is incorporated herein in its entirety by reference.

BACKGROUND OF THE INVENTION

1. Field of the Invention

Apparatuses and methods consistent with the present invention relate to digital audio broadcasting (DAB), and more particularly, to providing and receiving a video service in DAB.

2. Description of the Related Art

Analog audio broadcasting has drawbacks in that the quality of a signal input to an analog audio receiver significantly deteriorates when the analog audio receiver is moving; power efficiency is poor since strong transmission power is required to hide noise; and spectrum efficiency is poor due to the use of different frequencies in neighboring regions to eliminate channel interference. To address these problems, research into digital audio broadcasting (DAB) as a substitute for existing analog radio broadcasting, such as amplitude modulation (AM) and frequency modulation (FM) radio broadcasting, has been conducted. The European Telecommunication Standardization Institute (ETSI) has established the ETSI EN 300 401 standard for DAB.

ETSI EN 300 401, also called EUREKA-147, describes the provision of audio service and various additional services having compact disc (CD)-level quality at a bandwidth of about 2 MHz using a high-quality audio compression technique according to Moving Picture Experts Group (MPEG)-1 audio layer II. A plurality of audio data services are transmitted using Unequal Error Protection (UEP) and a plurality of data services are transmitted using Equal Error Protection (EEP) so as to optimize rates of data transmission at limited bandwidth and in a channel environment.

Through DAB, high-quality multi-channel audio and various types of additional data can be transmitted. Examples of additional data include still images, moving images, and graphics data. By transmitting the additional data, it is possible to provide multimedia services such as travel and traffic information, a program linkage information service that provides news images combined with headline characters or weather forecast and traffic information combined with electronic maps, a program independent information service that provides web site broadcasting or a Global Positioning System (GPS) for DAB, and a moving image service.

Among those services, an audio service, a packet mode data service, and a stream mode data service are provided according to the DAB standard (ETSI EN 300 401), but a video service using the stream mode data service is not prescribed in the DAB standard. As a result, for transmission/reception of video data, the DAB standard needs to be amended. This is because, in this case, although a separate standard determining a transmission method of a broadcasting station and a reception method of a receiver should be agreed between the broadcasting station and the receiver, a receiver that does not adhere to the standard cannot be provided with the video service through a DAB stream mode.

When the video service is provided using the stream mode data service that is a main service channel, encoding parameters related to the video service and information regarding a method used to packetize video data are generally included in a video service stream. Thus, for the video service, the encoding parameters used to encode data related to the video service and the method used to packetize the video data should be capable of determination by decoding the main service channel of DAB.

SUMMARY OF THE INVENTION

The present invention provides a method of and apparatus for providing and receiving a video service, in which the video service can be provided through a stream mode in digital audio broadcasting (DAB).

According to an aspect of the present invention, there is provided a method of providing a video service in DAB. The method includes inserting a profile identifier (ID) that specifies an encoding method used to encode a provided video service stream and program type information that indicates a type of the provided video service stream into a fast information channel (FIC) that is different from a service data channel comprising the video service stream; and multiplexing the service data channel and the FIC into a transmission frame for transmission.

The transmission frame may be a DAB transmission frame and the video service stream may comprise a video data stream or an audio data stream, or both audio and video data streams.

The profile ID may comprise information that specifies a video coding method.

The FIC may comprise fast information blocks (FIBs) of a predetermined size and a data field of each of the FIBs comprises at least one fast information group (FIG).

The FIC may comprise FIBs of a predetermined size, a data field of each of the FIBs comprises at least one FIG and the profile ID and the program type information are included in a single FIG.

According to another aspect of the present invention, there is provided a method of receiving a video service in DAB. The method includes receiving a DAB transmission frame and analyzing an encoding method and a program type of a received encoded video service stream based on a profile ID and program type information included in a fast information channel FIC of the DAB transmission frame that is received; and decoding the encoded video service stream included in a service data channel that is different from the FIC according to the encoding method and the program type that are analyzed.

According to still another aspect of the present invention, there is provided an apparatus for processing a video service in DAB. The apparatus includes an analyzing unit that receives a DAB transmission frame and analyzes an encoding method and a program type of a received encoded video service stream based on a profile ID and program type information included in a FIC of the DAB transmission frame that is received; and a video service decoder driving unit driving a decoder that decodes the encoded video service stream included in a service data channel that is different from the FIC according to the encoding method and the program type that are analyzed.

According to yet another aspect of the present invention, there is provided a transmitter for providing a video service in DAB. The transmitter includes an encoder that encodes the video service as a provided video service stream in a service data channel according to an encoding method; and a FIC processing unit which generates a profile ID that specifies the encoding method used to encode the provided video service stream and program type information that specifies a type of the provided video service stream in an FIC, wherein the service data channel is different from the FIC and comprises the provided video service stream, which is encoded according to the encoding method that is specified by the profile ID, and wherein the transmitter transmits the service data channel that comprises the video service stream and the FIC that comprises the profile ID and the program type information in a transmission data frame.

According to yet another aspect of the present invention, there is provided a method of providing a video service in DAB. The method includes inserting information that specifies a main component of a provided video service stream into a predetermined channel that is different from a service data channel that comprises the video service stream; and multiplexing the service data channel and the predetermined channel into a transmission frame for transmission.

According to yet another aspect of the present invention, there is provided a method of receiving a video service in DAB. The method includes receiving a DAB transmission frame, and analyzing information that specifies a main component of a provided video service stream, included in a predetermined channel of the DAB transmission frame that is received, which is different from a service data channel; and selectively decoding streams included in the video service stream based on the encoding method and the program type that are analyzed.

According to yet another aspect of the present invention, there is provided an apparatus for processing a video service in DAB. The apparatus includes an analyzing unit that receives a DAB transmission frame and analyzes information that indicates a main component of a provided video service stream included in a predetermined channel of the DAB transmission frame that is received, which is different from a service data channel; and a video service decoder driving unit driving a decoder that selectively decodes streams included in the video service stream according to the encoding method and the program type that are analyzed.

According to yet another aspect of the present invention, there is provided a transmitter for providing a video service in DAB. The transmitter includes a FIC processing unit that generates information that specifies a main component of a provided video service stream in an FIC; and a service data channel processing unit that processes the provided video service stream in a service data channel, wherein the transmitter transmits the service data channel that comprises the video service stream and the FIC that comprises the profile ID and the program type information in a transmission data frame.

BRIEF DESCRIPTION OF THE DRAWINGS

The above and other aspects of the present invention will become more apparent by describing in detail exemplary embodiments thereof with reference to the attached drawings in which:

FIG. 14 illustrates a program type code table used in an exemplary embodiment of the present invention;

FIG. 19 illustrates a frame structure according to another exemplary embodiment of the present invention.

DETAILED DESCRIPTION OF THE EXEMPLARY EMBODIMENTS OF THE INVENTION

Hereinafter, exemplary embodiments of the present invention will be described in detail with reference to the accompanying drawings.

Figure 1:
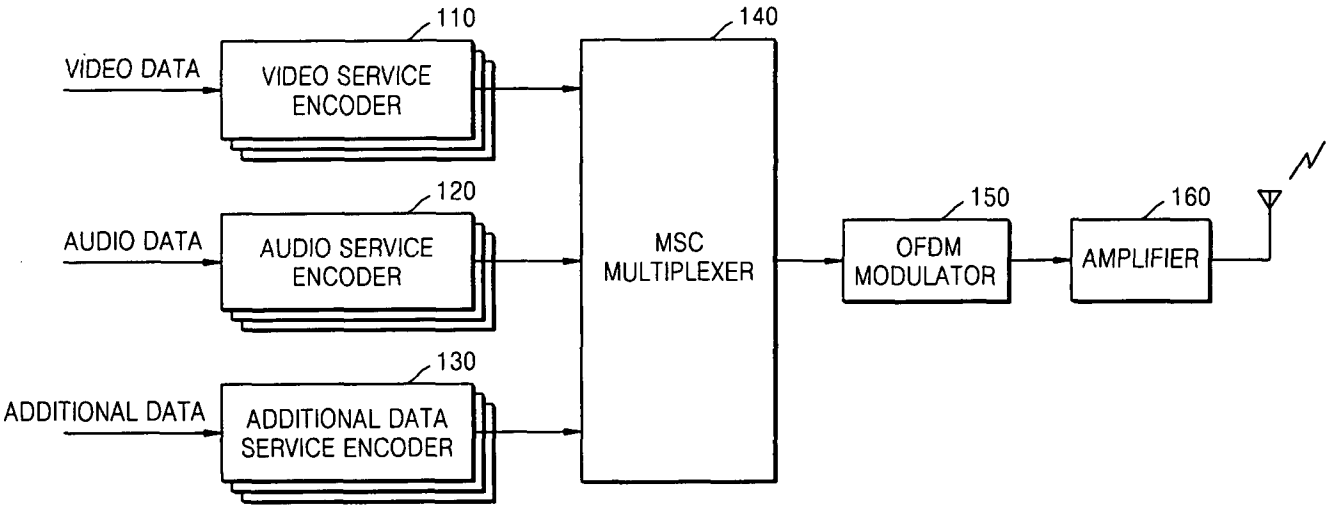
FIG. 1 is a block diagram of transmitter that provides a video service in a digital audio broadcasting (DAB) system according to an exemplary embodiment of the present invention.

FIG. 1 is a block diagram of a transmitter in a digital audio broadcasting (DAB) system that provides a video service according to an exemplary embodiment of the present invention.

The DAB system transmits not only audio service data but also video service data and additional service data. Thus, the DAB system includes a video service encoder 110, an audio service encoder 120, and an additional data service encoder 130. Audio service data to be broadcast, such as speech data or music, is input to the audio service encoder 120 to be encoded and channel-coded and the encoded data is then input to a main service channel (MSC) multiplexer 140. Since the DAB system can provide a plurality of audio services, it may include a plurality of audio service encoders 120.

Data such as character information and web information other than audio data is classified as packet mode data. The packet mode data is input to the additional data service encoder 130 to be encoded and channel-coded and is then input to the MSC multiplexer 140. Since the DAB system can provide a plurality of packet mode data services, it may also include a plurality of additional data service encoders 130.

In the DAB system, signals composing a video service include an audio signal, a video signal, and an additional data signal. Video service data including data of the video signal itself, such as a movie or a drama, additional data (e.g., subtitle data) related to the video signal, or packet mode data according to the DAB standard, such as character information, traffic information, still images, and web information, is classified as stream mode data, is input to the video service encoder 110 to be encoded into stream mode data and channel-coded, and is then input to the MSC multiplexer 140.

The MSC multiplexer 140 multiplexes the audio service, the packet mode data service, and the stream mode data service and adds corresponding additional information and multiplexing information and then synchronization information to each of the audio service, the packet mode data service, and the stream mode data service, thereby generating and outputting a DAB transmission frame. The DAB transmission frame passes through an orthogonal frequency division multiplexing (OFDM) modulator 150 and an amplifier 160 and is transmitted via very high frequency (VHF)-band waves. A DAB receiver may be of a fixed, portable, or mobile type.

Figure 2:
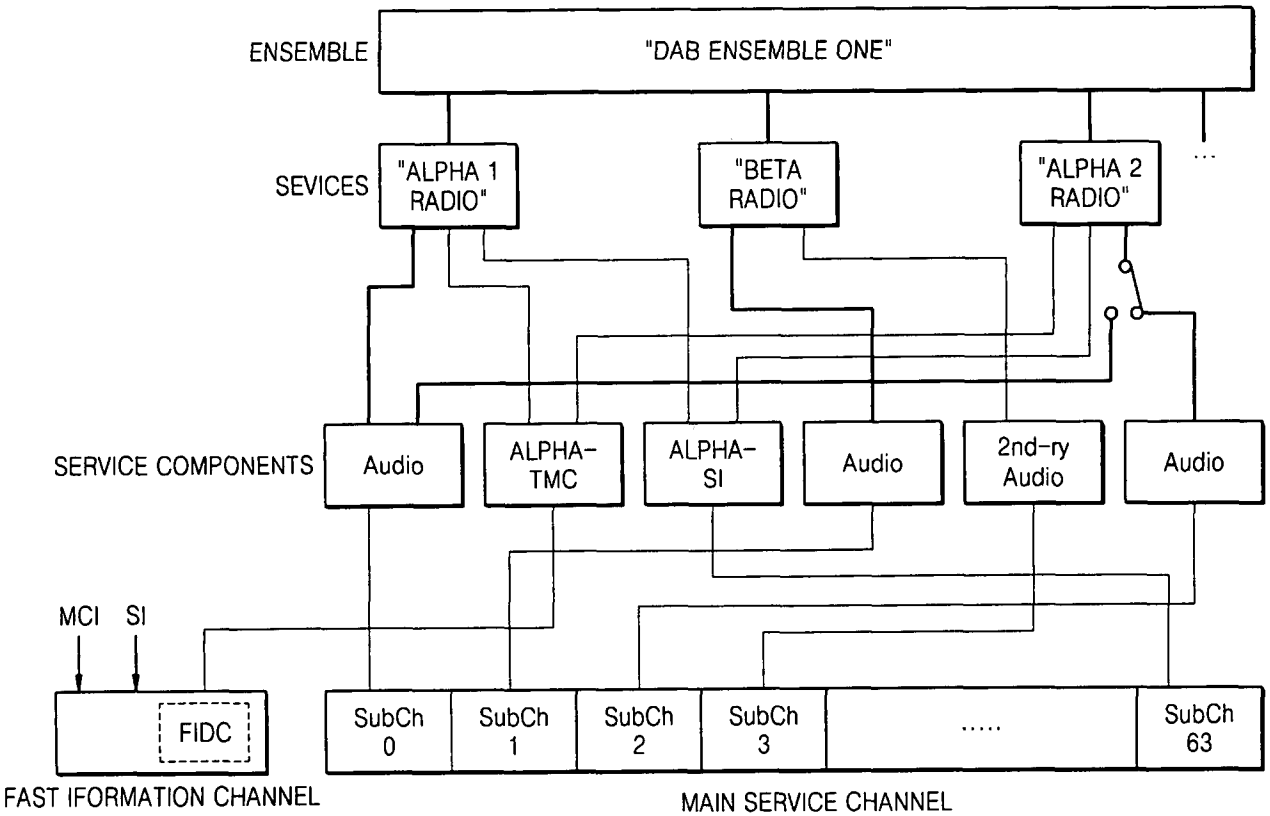
FIG. 2 illustrates service components and sub-channels of a single DAB ensemble according to an exemplary embodiment of the present invention.

FIG. 2 illustrates service components and sub-channels of a single DAB ensemble according to an exemplary embodiment of the present invention.

An ensemble generally denotes a bitstream obtained by channel-coding several encoded audio streams and a plurality of pieces of data and by multiplexing the channel-coded data with system data. Services generally denote outputs such as a program service or a data service selected by a user. Service components generally denote elements of the services. The service components of a service are linked to one another based on multiplex configuration information (MCI). Each of the service components is transmitted via a sub-channel SubCh or a fast information data channel (FIDC).

Referring to FIG. 2, "DAB ENSEMBLE ONE" generally denotes an example of a DAB ensemble that includes three services entitled "alpha1 radio", "beta radio", and "alpha2 radio". Each of the three services includes service components. For example, the "alpha1 radio" service includes service-components such as an audio service component, a traffic message channel (TMC) service component (i.e., ALPHA-TMC), and a service information (SI) service component (i.e., ALPHA-SI). These service components are transmitted via corresponding sub channels. For example, if the "alpha1 radio" service is a sports service, audio data broadcast on "alpha1 radio" is linked to the audio service component, related character information is linked to ALPHA-TMC, and information regarding the "alpha1 radio" is linked to ALPHA-SI. Here, SI denotes service information and TMC denotes a traffic message channel through which traffic information is supplied in real time.

The configurations of the services and their service components can be obtained from the MCI. In other words, the MCI specifies the service components of the respective services and thus allows a DAB receiver to analyze the service components. For example, when a user receives the ALPHA-TMC, the DAB receiver analyzes the MCI, recognizes that the ALPHA-TMC is transmitted via the fast information data channel (FIDC), reads information from the FIDC of a fast information channel (FIC), and provides "alpha1 radio" to the user. The FIDC is available for transmission of a small size of data to be transmitted within a predetermined time.

Since the service components are contained and transmitted in corresponding sub-channels, a sub-channel may be arbitrarily constructed by a service provider, and a pre-set sub-channel may be reconstructed when there is a change in the channel capacity or the services. If information regarding one of the sub-channels or one of the services is changed, new MCI is transmitted before transmission of the service so that the DAB receiver can properly receive the changed service.

Figure 3:
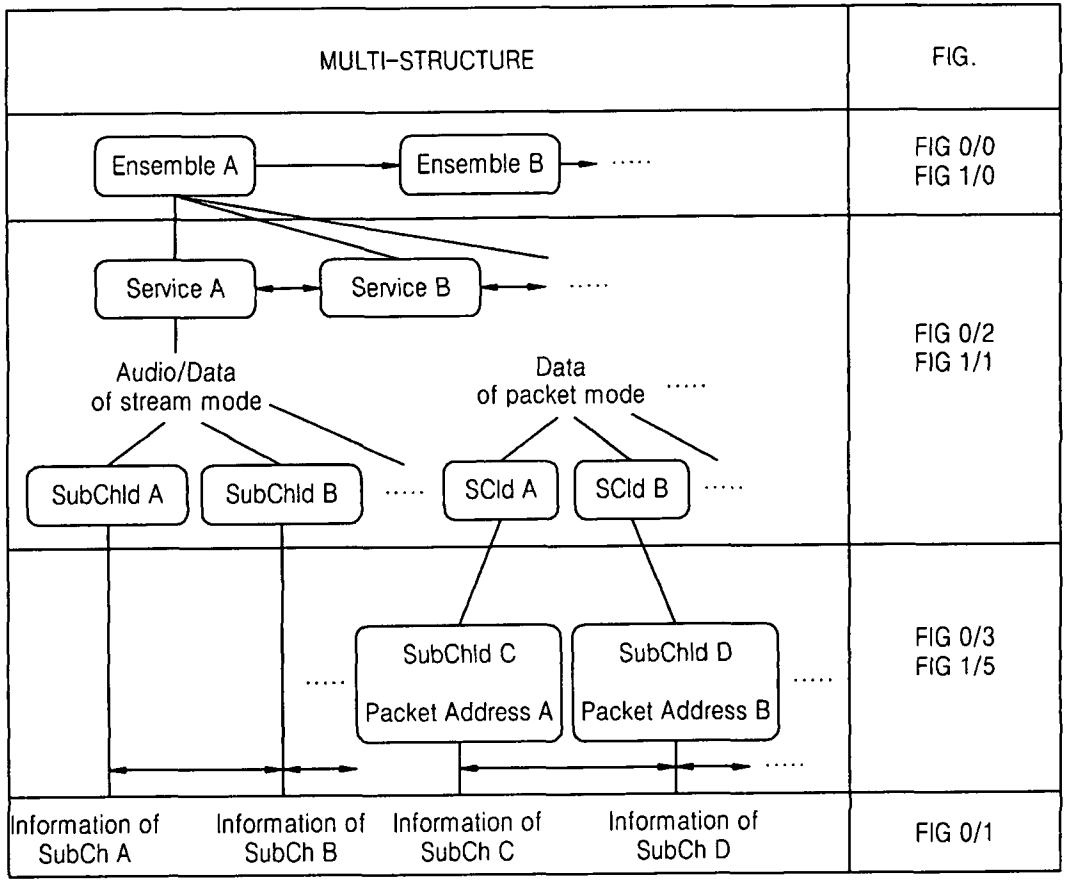
FIG. 3 illustrates a selection of content including a multi-structure and a fast information group (FIG) that stores configuration information regarding ensembles, services, and service components according to an exemplary embodiment of the present invention.

FIG. 3 illustrates a selection of content including a multi-structure and a FIG that stores configuration information regarding ensembles, services, and service components according to an exemplary embodiment of the present invention.

A FIG is a bundle of data used by an application in a FIC. Referring to FIG. 3, one service includes several service components and can be provided with various applications included in and transmitted via sub-channels corresponding to a sub-channel ID or a service component ID. DAB describes the structure of such a service using the FIC. Accordingly, to receive a service selected by a user, information regarding a destination channel of the selected service and the channel size (i.e., sub-channel information) is obtained from the MCI carried over the FIC, and the selected service is provided to the user or displayed on a screen. FIGs constitute a fast information block (FIB) that is carried over the FIC regarding a service, and thus, an analysis of the FIG structure provides information regarding the service.

Figure 4:
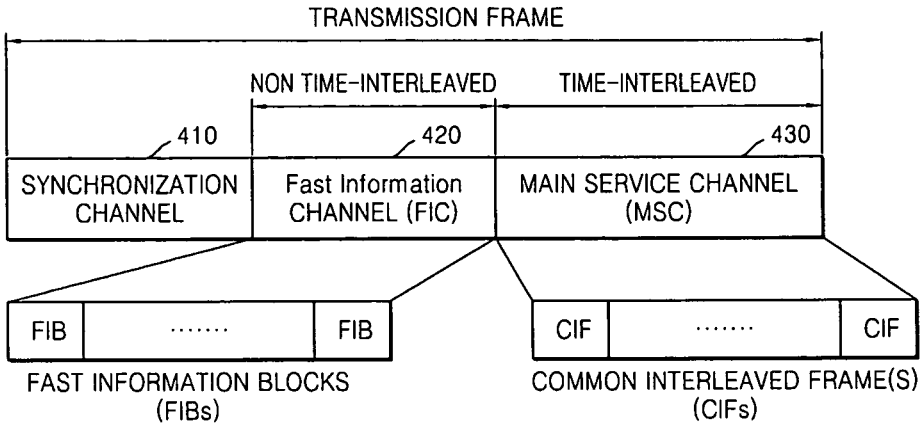
FIG. 4 illustrates the structure of a DAB transmission frame according to an exemplary embodiment of the present invention.

FIG. 4 illustrates a DAB transmission frame according to an exemplary embodiment of the present invention.

The DAB transmission frame includes a synchronization channel (SC) 410, a FIC 420, and an MSC 430.

The SC 410 includes a null symbol that allows selection of a transmission mode, and a reference symbol required for OFDM symbol synchronization and carrier frequency synchronization. The FIC 420 is used to transmit information required by a DAB receiver to process data (e.g., information regarding service structure or the structure of multiplexed service data, or data that must be quickly transmitted). The FIC 420 contains MCI specifying the structures of sub-channels, and SI, which includes additional information regarding the services. Accordingly, the type of channel reveals the type of service data transmitted via the MSC 430 and the type of application that will use the service. The FIC 420 may further contain data that must be quickly transmitted within a predetermined time (e.g., FIDC data). For instance, short emergency messages can be transmitted via the FIC 420. FIG structures constituting the FIC 420 will be described later with reference to FIG. 8.

Substantial content data provided by a service provider is transmitted through the MSC 430. If the FIC 420 cannot accommodate all the data for an FIC, FIC data can be partially included in the MSC 430. However, since time interleaving is applied to the MSC 430, a time delay occurs during the decoding of data. For this reason, FIC data that needs to be quickly transmitted is preferably not included in the MSC 430. Data can be transmitted in a stream mode or a packet mode. In the stream mode, data is transmitted at a fixed bit rate without an additional header in a given sub-channel. In the packet mode, data is transmitted together with a header, and thus, various service components can be multiplexed in a given sub-channel. Accordingly, analysis of a header of a packet is further required in the packet mode to extract the data from a combination of the data and the header.

Figure 5:
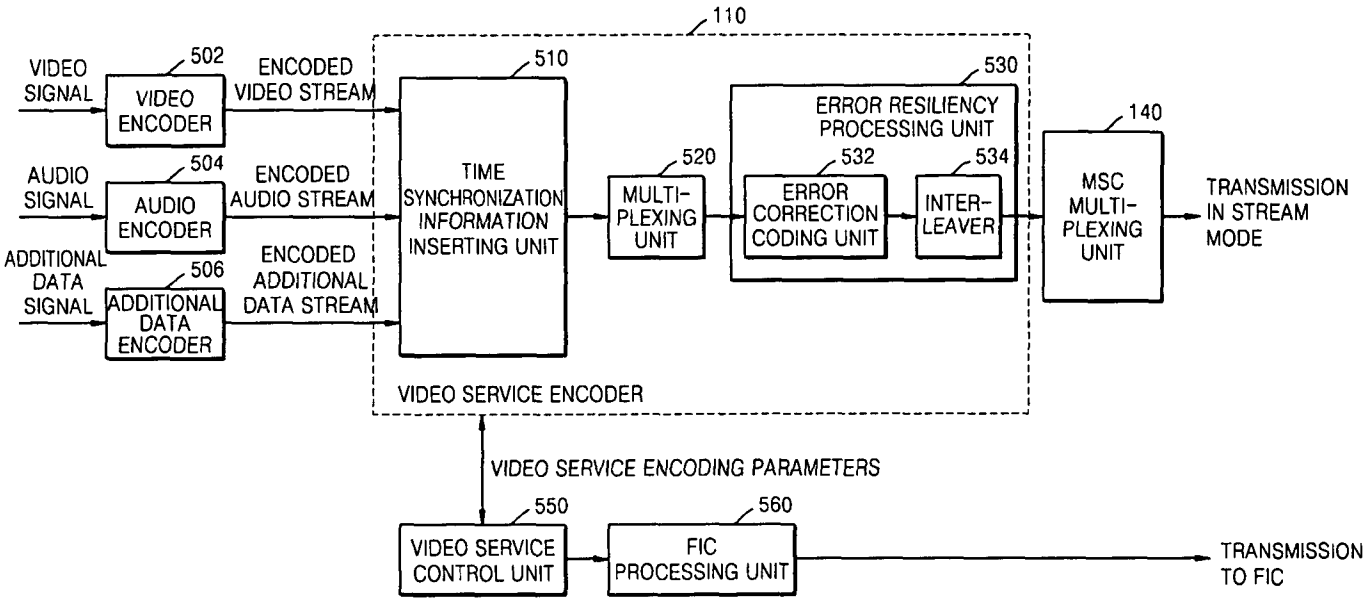
FIG. 5 is a detailed block diagram of a video service encoder for providing a video service according to an exemplary embodiment of the present invention.

FIG. 5 is a detailed block diagram of the video service encoder 110 for providing a video service according to an exemplary embodiment of the present invention.

A video signal is encoded by a video encoder 502, an audio signal is encoded by an audio encoder 504, and an additional data signal is encoded by an additional data encoder 506.

Packet mode data such as character information, traffic information, still images, and web information transmitted according to a packet mode of DAB may be used as additional data in a packetized form according to a corresponding standard. When packet data transmitted as the packet mode data of the DAB is transmitted as additional data of the video service, error correction is performed by an error resiliency processing unit 530 included in the video service encoder 110 for channel error resilient transmission, thereby reducing transmission errors compared to conventional transmission according to the packet mode.

The video encoder 502 records information regarding an encoding method used to encode an input video signal. For example, if the input video signal is encoded using MPEG-4 video coding, then the size, MPEG-4 profile, and level of an input video are recorded in a header of an encoded video stream. Such information regarding video encoding is parameterized and output. The audio encoder 504 also records information regarding an encoding method used to encode an input audio signal. For example, if the input audio signal is encoded using MPEG-4 audio coding, then the sampling rate and the number of channels of an input audio are recorded in a header of an encoded audio stream. The information regarding audio encoding is also parameterized and output.

The additional data encoder 506 parameterizes and outputs information regarding the type of an input additional data signal that is packet mode data, such as character information, traffic information, still images, and web information or encoded general additional data.

The video service encoder 110 receives an encoded video stream, an encoded audio stream, and an encoded additional data stream to generate a video service stream, multiplexes the video service stream with other service data through the MSC multiplexer 140, and transmits the multiplexed data in a stream mode. The video service encoder 110 includes a time synchronization information inserting unit 510, a multiplexing unit 520, and an error resiliency processing unit 530.

The time synchronization information inserting unit 510 inserts time synchronization information to allow audio data of the encoded audio stream, video data of the encoded video stream, and the video data stream to be reproduced in synchronization with one another. In other words, since the video encoder 502, the audio encoder 504, and the additional data encoder 506 encode input data independent of each other, information regarding the output of encoded data in connection with the other input data is not included, which results in a need to additionally provide time synchronization information. For example, when a method defined in the MPEG-4 synchronization layer (SL) is used, time synchronization information is inserted into an MPEG-4 SL header to add the time synchronization information to each of the encoded video stream, the encoded audio stream, and the encoded additional data stream, respectively. The time synchronization information is also parameterized and output.

The multiplexing unit 520 multiplexes the encoded audio stream, the encoded video stream, and the encoded additional data stream, each of which includes the time synchronization information, into a single TS. The multiplexing unit 520 may perform multiplexing using various methods. For example, in the case of multiplexing using an MPEG-2 TS, the multiplexing unit 520 generates and multiplexes a 188-byte MPEG-2 TS packet. A program ID (PID) of data included in the MPEG-2 TS packet is recorded in the multiplexed TS. Such multiplexing information including the PID is also parameterized and output.

The multiplexed TS is input to the error resiliency processing unit 530 to handle a transmission error. The error resiliency processing unit 530 includes an error correction coding unit 532 and an interleaver 534.

The error correction coding unit 532 adds error correction data to the end of payload data to be transmitted. The interleaver 534 rearranges the position of each byte of a TS to which the error correction data is added using convolutional interleaving. For example, when the multiplexed TS is an MPEG-2 TS, the size of a single MPEG-2 TS packet is 188 bytes and the error correction data is added to the end of 188 bytes. The error correction coding unit 532 may generate the error correction data using Reed-Solomon coding and the interleaver 534 may use convolutional interleaving. Information about an error correction coding method and an interleaving method is also parameterized and output.

Such an error-resilient TS processed by the error resiliency processing unit 530 is transmitted by the MSC multiplexer 140 over the MSC of DAB.

The parameterized information is called video service encoding parameters that are input to a video service control unit 550. The video service control unit 550 transmits the video service encoding parameters to a FIC processing unit 560 for transmission over the FIC, and the FIC processing unit 560 codes the video service encoding parameters and transmits the coded video service encoding parameters over the FIC. Among the received video service encoding parameters, encoding information of the video signal and the audio signal is recorded as a profile in the FIC. The error correction coding method and the interleaving method used in the error resiliency processing unit 530 are recorded in a data service component type (DSCTy) field of a FIG. 0/2 and the time synchronization information inserting method and the multiplexing method are recorded in a user application field of a FIG. 0/13 for transmission via the FIC. A recording method used for the video service encoding parameters will be described in detail later.

The video service encoding parameters are video service related information used for the DAB receiver to receive and process the video service. The video service encoding parameters are required for initializing a decoder and a demultiplexer. In other words, it is necessary to previously recognize whether the stream mode data included in the MSC corresponds to the video service, recognize encoding methods used for each of the audio stream, the video stream, and the additional data stream of the video service, and recognize the error resiliency method.

In brief, the video service encoding parameters include not only information regarding encoding, synchronization, and packetization of the video stream of the video service but also information required for initialization of a video decoder of the DAB receiver. In addition, the video service encoding parameters include not only information regarding encoding, synchronization, and packetization of the audio stream of the video service but also information required for initialization of an audio decoder of the DAB receiver. In the stream mode used to provide the video service, the start and the end of data are not designated. As a result, among continuously input packets, the start of data should be recognized. In the case of an MPEG-2 TS, a start point can be recognized by searching for a sync pattern beginning with 0×47. In other cases, a predetermined pattern is designated as a sync pattern and the sync pattern is determined to indicate the start of data. The end of data can be recognized by adding a packet number of a corresponding packet or information regarding whether the corresponding packet is the last packet to the rear of the sync pattern. The video service encoding parameters also include information such as the PID, program attribute table (PAT), program map table (PMT) of each of the audio stream, the video stream, and the additional data stream of the video service for demultiplexing of the multiplexed TS.

Figure 6:
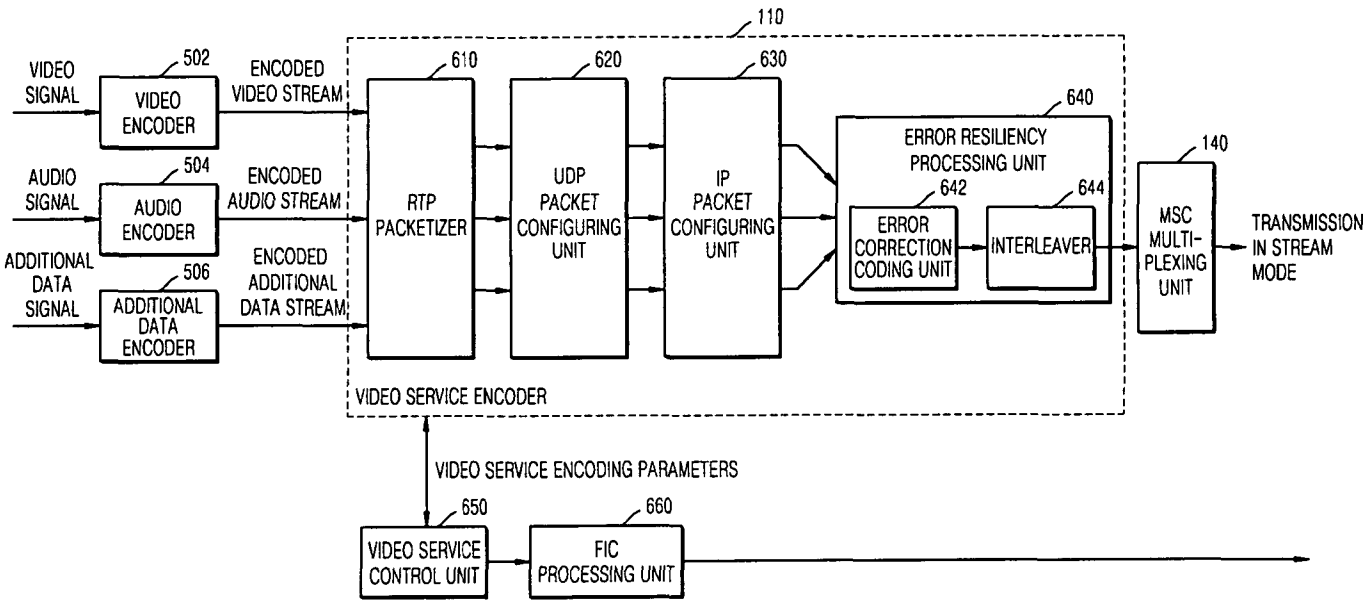
FIG. 6 is a detailed block diagram of a video service encoder for providing a video service, in which video service data is configured with IP packets according to an exemplary embodiment of the present invention.

Although video service data is generated and transmitted based on MPEG-2 TS packets in FIG. 5, it may also be provided using IP packets as in FIG. 6.

FIG. 6 is a detailed block diagram of the video service encoder 110 for providing a video service, in which video service data is configured with IP packets according to an exemplary embodiment of the present invention.

The configurations and functions of the video encoder 502, the audio encoder 504, and the additional data encoder 506 have been already described with reference to FIG. 5.

A real-time transport protocol (RTP) packetizer 610 packetizes each of the encoded video stream, the encoded audio stream, and the encoded additional data stream into RTP packets using an RFC among various RTP packetization methods; If RTP packetization is used, payload types of an audio RTP packet and a video RTP packet are recorded in an RTP header and the RTP header is output as a video service encoding parameter. The audio RTP packet, the video RTP packet, and an additional data RTP packet are input to a UDP packet configuring unit 620 and an IP packet configuring unit 630. The UDP packet configuring unit 620 generates a UDP packet by adding a UDP header to the input RTP packet and the IP packet configuring unit 630 generates an IP packet by adding an IP header to the generated UDP packet.

The generated IP packet is input to the error resiliency processing unit 640 to handle transmission errors. Since the IP packet generally has a variable length, the packet length of the IP packet should be changed to have a fixed length like an MPEG-2 TS packet to allow the use of the error resiliency method applied to MPEG-2 TS packets. Thus, the IP packet is sliced to have the same form as the MPEG-2 TS packet. After 188 bytes are formed using synchronization data or payload data or the IP packet is multiplexed using conventional MPEG-2 TS multiplexing, the 188 bytes or the IP packet is input to the error resiliency processing unit 640 for addition of the error correction data. The error correction coding method and the interleaving method are output as the video service encoding parameters.

Such an error-resilient TS processed by the error resiliency processing unit 640 is transmitted by the MSC multiplexer 140 over the MSC of DAB.

The parameterized information is in the form of video service encoding parameters that are input to a video service control unit 650. The video service control unit 650 transmits the video service encoding parameters to a FIC processing unit 660 for transmission over the FIC, and the FIC processing unit 660 codes the video service encoding parameters and transmits the coded video service encoding parameters over the FIC. Among the received video service encoding parameters, encoding information of the video signal and the audio signal is recorded as a profile in the FIC. The error correction coding method and the interleaving method used in the error resiliency processing unit 640 are recorded in a DSCTy field of a FIG. 0/2 and the packetization information used in the RTP packetizer 610 is recorded in a user application field of a FIG. 0/13 for transmission via the FIC.

Figure 7:
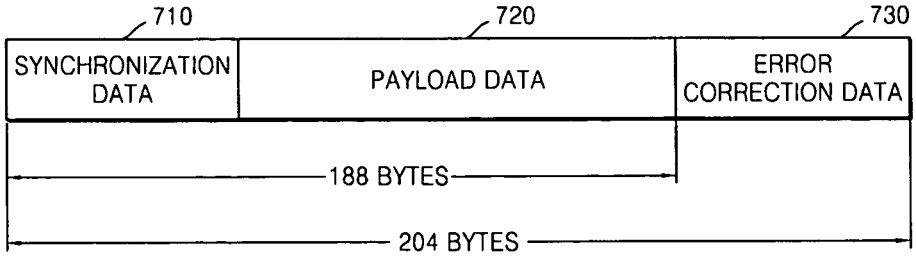
FIG. 7 illustrates the structure of an MPEG-2 transport stream (TS) packet generated by inserting synchronization data and error correction data according to an exemplary embodiment of the present invention.

FIG. 7 illustrates the structure of an MPEG-2 TS packet generated by inserting synchronization data and error correction data according to an exemplary embodiment of the present invention.

Referring to FIG. 7, a 188-byte MPEG-2 TS packet is formed using synchronization data 710 and payload data 720 and error correction data 730 that is generated using an error correction encoding method, such as Reed-Solomon coding, is added to the MPEG-2 TS packet.

Figure 8:
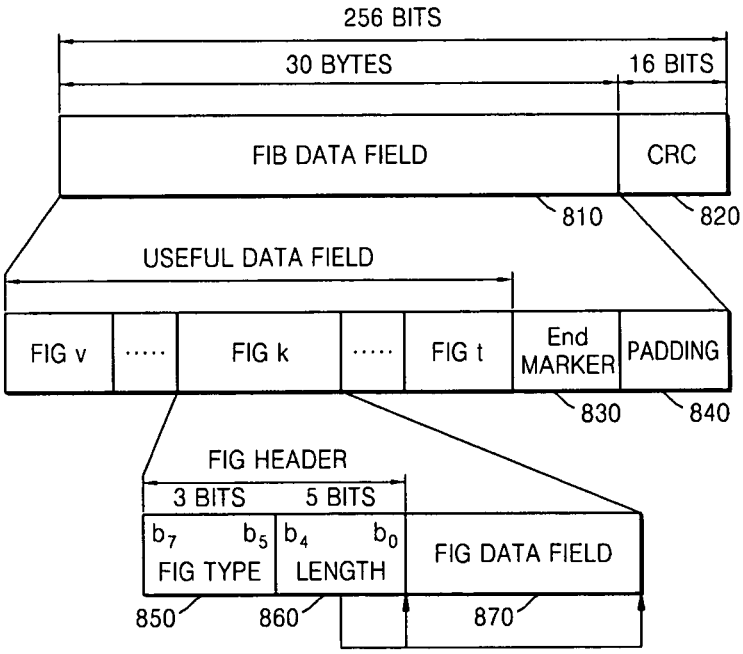
FIG. 8 illustrates the structure of a fast information block (FIB) according to an exemplary embodiment of the present invention.

FIG. 8 illustrates the structure of a FIB according to an exemplary embodiment of the present invention.

The FIB, a plurality of which are included in a FIC, includes a FIB data field 810 and a CRC field 820. The FIB data field 810 is composed of 30 bytes and includes FIGs. When the FIB data field 810 cannot be completely filled up with FIG data, an end marker 830 is inserted to inform the DAB receiver that there is no further FIG data and channel data 840 is padded, thereby forming a 256-bit FIB. The end marker 830 may be, for example, "111 11111". In each of the FIGs, a FIG type field 850 indicating the type of data included in a FIG data field 870 and a length field 860 indicating the length of the FIG data field 870 are inserted in a FIG header and actual data is included in the FIG data field 870. FIG type information or syntax information of the actual data varies with an application used or information to be informed. Hereinafter, formats of FIG types related to service processing according to exemplary embodiments of the present invention will be described.

Figure 9:
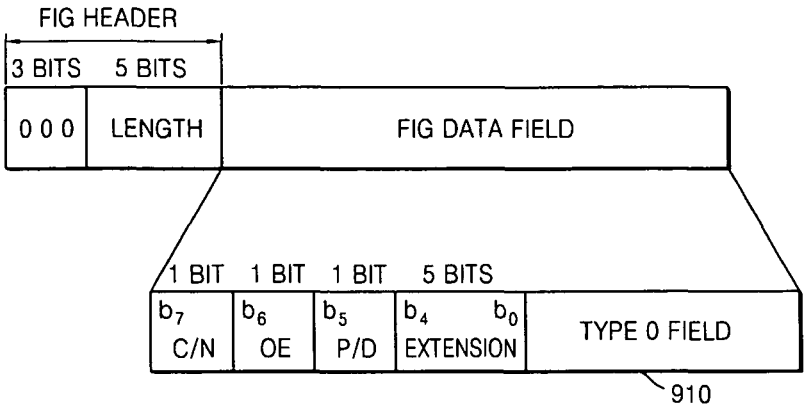
FIG. 9 illustrates the structure of a FIG type 0 according to an exemplary embodiment of the present invention.

FIG. 9 illustrates the structure of a FIG type 0 according to an exemplary embodiment of the present invention.

The FIG type 0 contains information regarding the structures of current and future multiplex configuration, multiplex re-configuration, time and data, and other basic service information. A FIG type 0 field 910 includes various kinds of information according to the extension of the FIG type 0.

Figure 10:
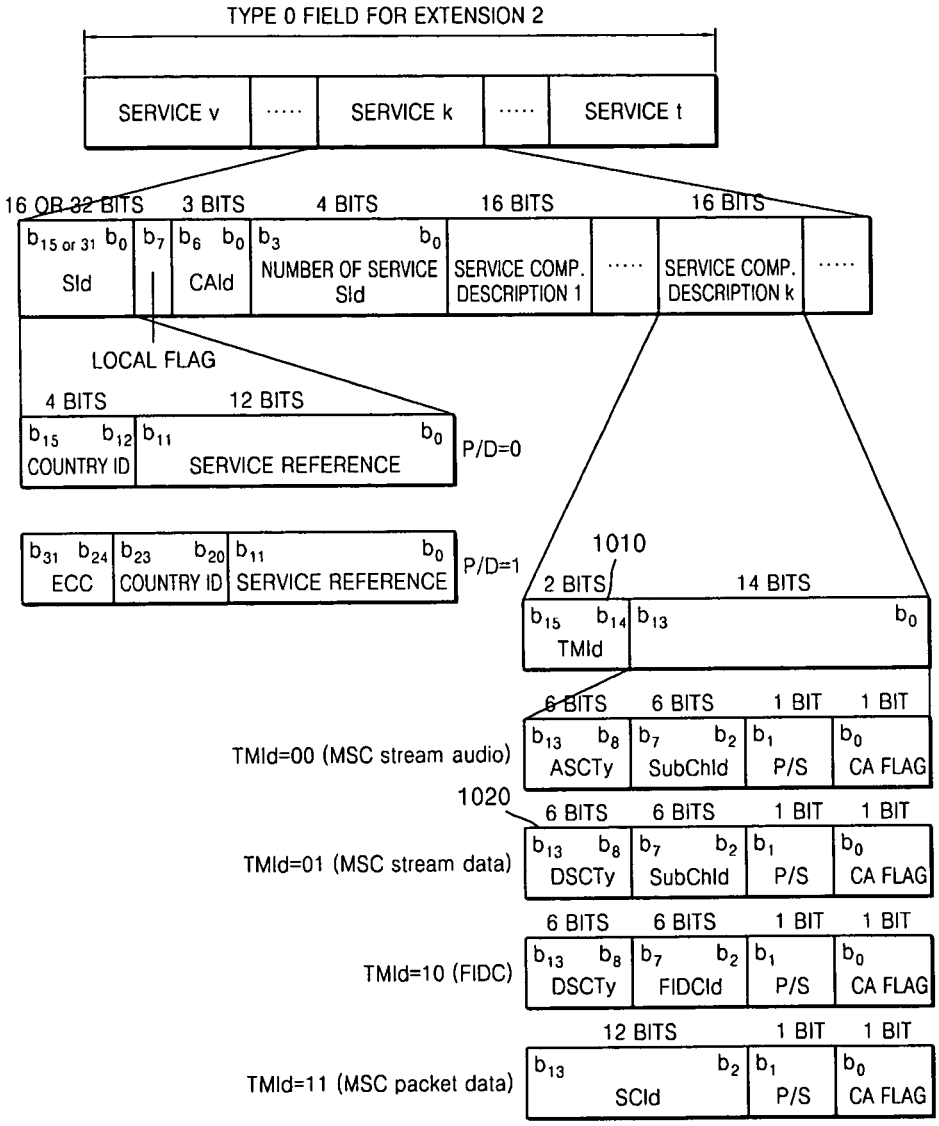
FIG. 10 illustrates the structure of a FIG. 0/2 according to an exemplary embodiment of the present invention.

FIG. 10 illustrates the structure of a FIG type 0, extension 2 (i.e., FIG. 0/2) according to an exemplary embodiment of the present invention. FIG. 10 illustrates a detailed structure of the FIG type 0 field 910 of FIG. 9, for extension 2. The FIG. 0/2 contains information regarding service components. A description of a service is contained in a service field k (k is an integer).

A transport mechanism identifier (TMId) field 1010 indicates that a service component is a stream mode data service when a TMId is 01. A DSCTy field 1020 should be newly defined for a video service using the stream mode. In an exemplary embodiment of the present invention, the application of the error resiliency method is recorded in the DSCTy field 1020. For example, if a Reed-Solomon error correction coding method RS (204,188) and a convolutional interleaving method (12×17) are used in the stream mode for the video service and a Reed-Solomon error correction coding method RS(208,192) and a block interleaving method are used in the packet mode for the multimedia service, the following application is suitable for allowing the DAB receiver to distinguish such uses.

DSCTy: value nnnnnn: stream mode for video service (RS (204,188), CI(12×17))

DSCTy: value mmmmmm: packet mode for multimedia service (RS(208,192), blocking interleaving)

Figure 11A:
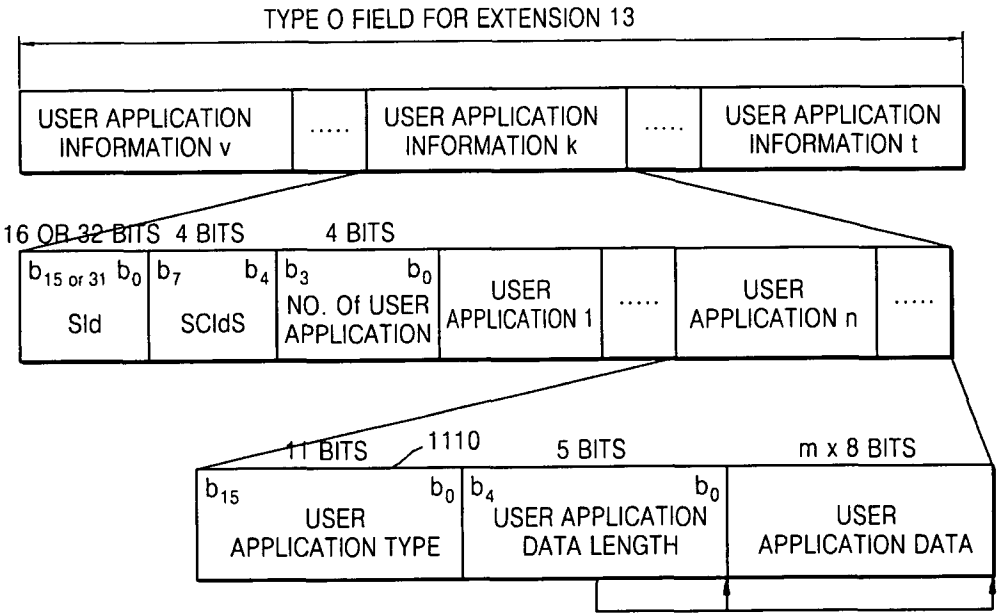
FIG. 11A illustrates the detailed structure of a user application filed of a FIG. 0/13 according to an exemplary embodiment of the present invention.

FIG. 11A illustrates a detailed structure of a user application field of a FIG type 0, extension 13 (i.e., FIG. 0/13) according to an exemplary embodiment of the present invention.

The FIG. 0/13 records data required for a service decoder of the DAB receiver. Among fields of the FIG. 0/13, a user application type field 1110 indicates a user application module to be used to decode data corresponding to a service ID (SId). In the case of a video service using the stream mode, the user application type field 1110 may be defined as the video service.

A user application data field 1120 includes information regarding the encoding method, the packetization method, and the multiplexing method used for the video service and information regarding a user program type for each packet mode defined in the DAB standard when packet mode data such as character information, traffic information, still images, and web information are used as additional data. The video service encoding parameters having a format as illustrated in FIG. 12 are recorded in the user application data field 1120.

The video service encoding parameters may be recorded by newly defining an extension of the FIG type 0. In this case, the user application field is generated as illustrated in FIG. 11B.

Figure 11B:
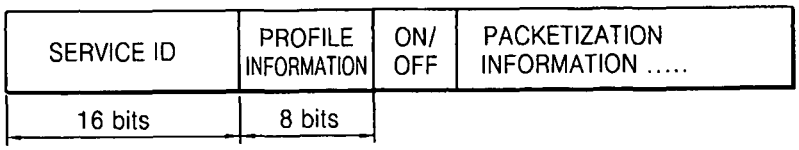
FIG. 11B illustrates the structure of a newly defined FIG for video service encoding parameters according to an exemplary embodiment of the present invention.

FIG. 11B illustrates the structure of a newly defined FIG for the video service encoding parameters according to an exemplary embodiment of the present invention.

Figure 12:
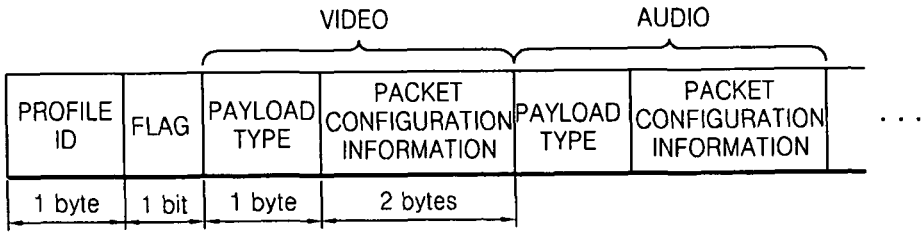
FIG. 12 illustrates a data structure including video service encoding parameter information and packetization information including profile information and other information according to an exemplary embodiment of the present invention.

A 16-bit service ID (SId) is recorded in the first portion of the user application field and video service encoding parameters having a format as illustrated in FIG. 12 are recorded after the service ID, thereby implementing a FIG for video service encoding parameters.

FIG. 12 illustrates a data structure including video service encoding parameter information and packetization information including profile information and other information according to an exemplary embodiment of the present invention.

The video service encoding parameter information and the packetization information includes a profile ID and packetization information for the video stream and the audio stream. Hereinafter, the profile ID will be described in detail. For example, when MPEG-4 Advanced Video Coding (AVC) is used for video encoding, MPEG-4 Bit Sliced Arithmetic Coding (BSAC) is used for audio encoding, and an MEPG-2 TS using an MPEG-4 sync layer (SL) is used for packetization and multiplexing, an index 0×00 of Table 1 recorded as a profile is recorded in a profile ID field, instead of recording each of packetization and multiplexing methods used for the video stream and the audio stream in the user application data field.

TABLE 1

| Profile ID | Profile description | Video codec | Audio codec | Muxing/packet |
|---|---|---|---|---|
| 0x00 | Video service 1 | MPEG-4 AVC | MPEG-4 BSAC | MPEG-2 TS with MPEG-4 SL |
| 0x01 | Video service 2 | MPEG-4 AVC | MPEG-4 AAC | MPEG-2 TS with MPEG-4 SL |
| 0x02 | Video service 3 | MPEG-4 AVC | MPEG-4 AAC | MPEG-2 TS with MPEG-2 PES |

TABLE 1-continued

| Profile ID | Profile description | Video codec | Audio codec | Muxing/packet |
|---|---|---|---|---|
| 0x03 | Video service 4 | MPEG-4 Part 2 | MPEG-2 AAC | MPEG-2 TS with MPEG-2 PES |

The video service encoding parameter information may be included in a FIG. 0/8 and a FIG. 0/13 among FIGs, but the video service control unit of the DAB receiver processes the video service using the video service encoding parameter information.

The profile information and other information may be assigned to separate FIGs to record the video service encoding parameter information and the packetization information in at least two different FIGs. The profile information and other information may also be provided as essential information when an electronic program guide (EPG) is provided during broadcasting. Thus, by analyzing the video service encoding parameter information and the packetization information of the video service, it is possible to previously determine whether a provided service can be processed by the DAB receiver.

By recording the type of a video service, such as a news program or an educational program, together with the profile ID, in the user application data field, the DAB receiver can classify received video services according to their types and may provide information regarding the types of the video services to a user as additional information. For example, when the user wishes to watch a news program among the received video services, only programs corresponding to the news program among the received video services may be listed through information received via the FIC.

Figure 13:
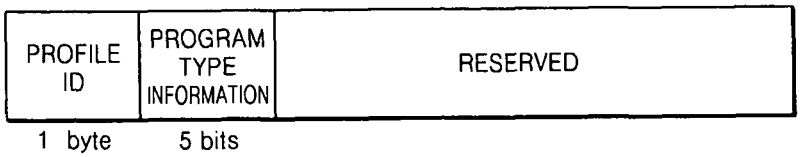
FIG. 13 illustrates a frame structure according to an exemplary embodiment of the present invention.

FIG. 13 illustrates a frame structure according to an exemplary embodiment of the present invention. As illustrated in FIG. 13, the type of a video service, e.g., the type of a provided program, is specified by a 5-bit field following a profile ID field. To this end, the 5-bit field as illustrated in FIG. 13 or a predetermined-length field may be used.

FIG. 14 illustrates a program type code table used in an exemplary embodiment of the present invention. When the 5-bit field is used, values in a table of ETSI TS 101 756 used in a standard of the European Telecommunications Standards Institute (ETSI) may be used as illustrated in FIG. 14. As such, by using a conventional DAB program type table as a table for specifying programs of video/audio services, more efficient use of a memory of the DAB receiver is possible. A separate program type table for a video service may also be defined.

Figure 15:
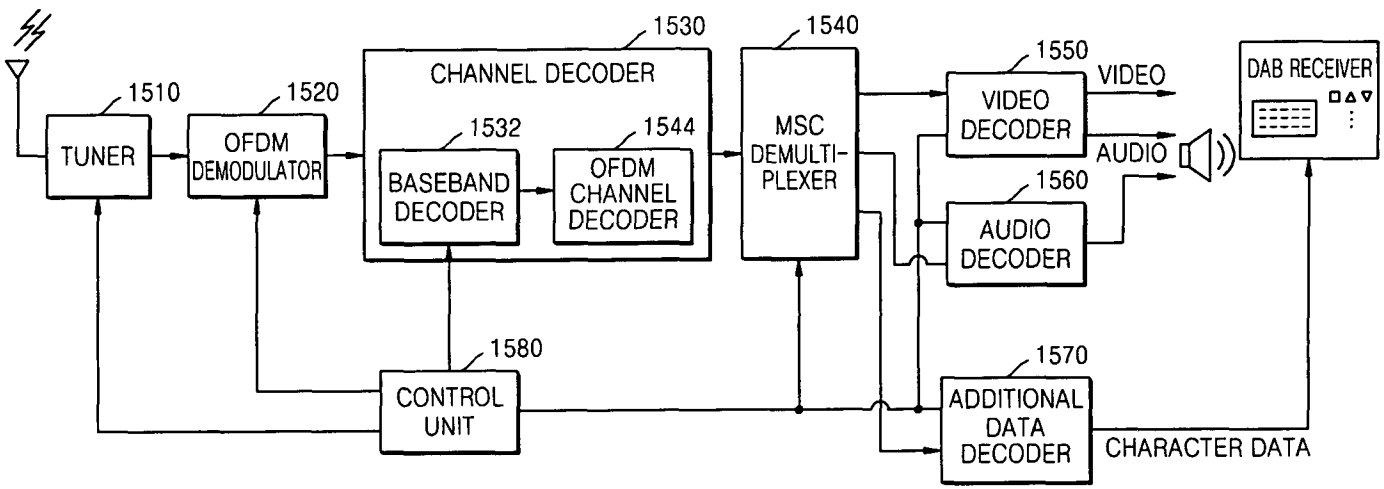
FIG. 15 is a block diagram of a receiver that receives a video service in a DAB system according to an exemplary embodiment of the present invention.

FIG. 15 is a block diagram of a receiver that receives a video service in a DAB system according to an exemplary embodiment of the present invention.

The receiver receives an OFDM modulated signal through a tuner 1510 and demodulates the OFDM modulated signal through an OFDM demodulator 1520, thereby generating a DAB transmission frame.

A channel decoder 1530 includes a baseband decoder 1532 and an OFDM channel decoder 1534. The channel decoder 1530 parses FIC data to generate a service list and shows the service list to the user.

The FIC data includes the video service encoding parameter information and the packetization information, and thus, an analysis of the FIC data can provide the type of a provided service and the encoding method and packetization method used for data of the provided service.

The FIC data also includes program type information that specifies the type of a provided video service. The channel decoder 1530 can recognize the type of a provided video service by analyzing the program type information of the FIC data.

A control unit 1580 transmits the type of a video service analyzed by the channel decoder 1530 to an additional data decoder 1570 to show the analyzed type to the user through a display unit (not shown) of the receiver.

If the user selects a service, an MSC demultiplexer 1540 extracts and outputs service data corresponding to the selected service. If the user selects a video service, an encoded video stream, an encoded audio stream, and an encoded additional data stream of the selected video service are transmitted to a video decoder 1550, an audio decoder 1560, and an additional data decoder 1570 for decoding.

The control unit 1580 controls functional components according to the video service encoding parameter information and the packetization information.

Figure 16:
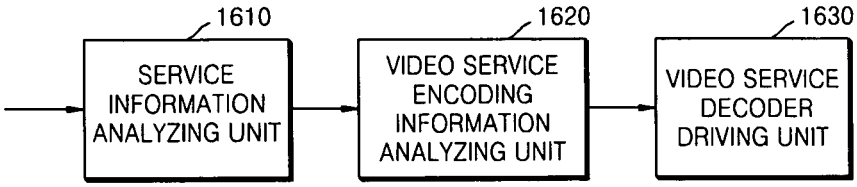
FIG. 16 is a detailed block diagram of a video service control unit of FIG. 5 according to an exemplary embodiment of the present invention.

FIG. 16 is a detailed block diagram of the video service control unit 550 according to an exemplary embodiment of the present invention.

The video service control unit 550 includes a service information analyzing unit 1610, a video service encoding information analyzing unit 1620, and a video service decoder driving unit 1630.

The service information analyzing unit 1610 analyzes the FIG. 0/2 of FIG. 10 to show a provided service to the user and analyzes information regarding sub-channels and service components related to a video service selected by the user.

The video service encoding information analyzing unit 1620 analyzes the error resiliency method of the video service through the DSCTy of the FIG. 0/2 and the video service decoding method used for the video service through the user application type and user application data of the FIG 0/13. The video service decoder driving unit 1630 drives the video service decoder including the error resiliency processing unit based on video service encoding information recognized through the analysis.

Figure 17A:
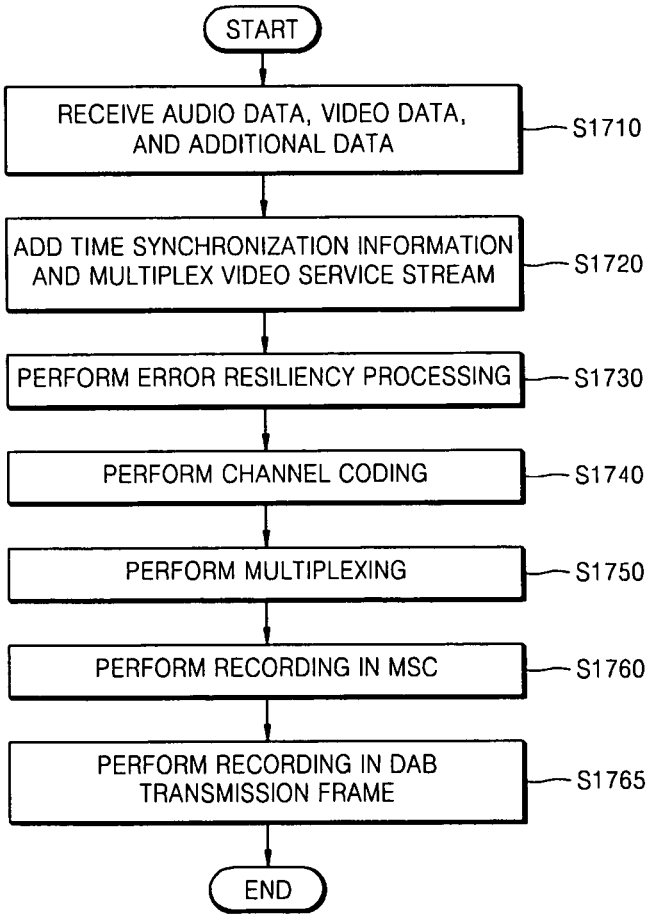
FIGS. 17A and 17B are flowcharts illustrating a method of providing a video service according to an exemplary embodiment of the present invention.
Figure 17B:
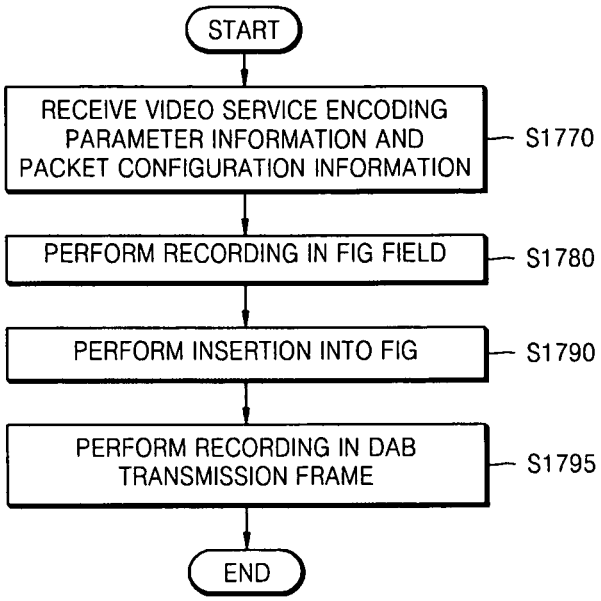

FIGS. 17A and 17B are flowcharts illustrating a method of providing a video service with reference to video service encoding information and packet configuration information in a stream mode of DAB, according to an exemplary embodiment of the present invention.

Encoded audio data, video data, and additional data, which are related to a video service, are received from outside or audio data and video data encoded by an audio encoder and a video encoder included in a video service encoder are transmitted in operation S1710. Time synchronization information is inserted and a video service stream is multiplexed to smoothly provide the video service in operation SI 720. Error correction data is added and convolutional interleaving is performed through an error-resiliency processing unit in operation S1730. After the error-resilient stream is channel-coded in operation S1740, the stream is multiplexed in operation S1750, recorded in an MSC in operation S1760. The stream is then recorded in a DAB transmission frame together with a FIC, which includes video service encoding parameters, for transmission in operation S1765.

Video service encoding parameter information and packet configuration information are received in operation S1770, recorded in a FIG field in operation S1780, and inserted into the FIC in operation S1790. In other words, information used for a DAB receiver to smoothly process a provided video service is inserted into the FIC, instead of the MSC that is a service data channel. The FIC is composed of FIBs, each of which includes several FIGs. In an exemplary embodiment of the present invention, fields are changed and newly defined in FIG. 0/8 and FIG. 0/13. The video service encoding parameter information and the packet configuration information are included in the newly defined fields of FIG. 0/8 and FIG. 0/13. The video service encoding parameter information is multiplexed with the MSC, thereby generating the DAB transmission frame in operation S1795. The structures of the FIG. 0/8 and the FIG. 0/13 have already been described above.

In operation S1795, program type information indicating the type of the provided video service, provided together with the program ID in the user application data field of the FIG, may also be multiplexed with the MSC, thereby generating the DAB transmission frame.

Figure 18:
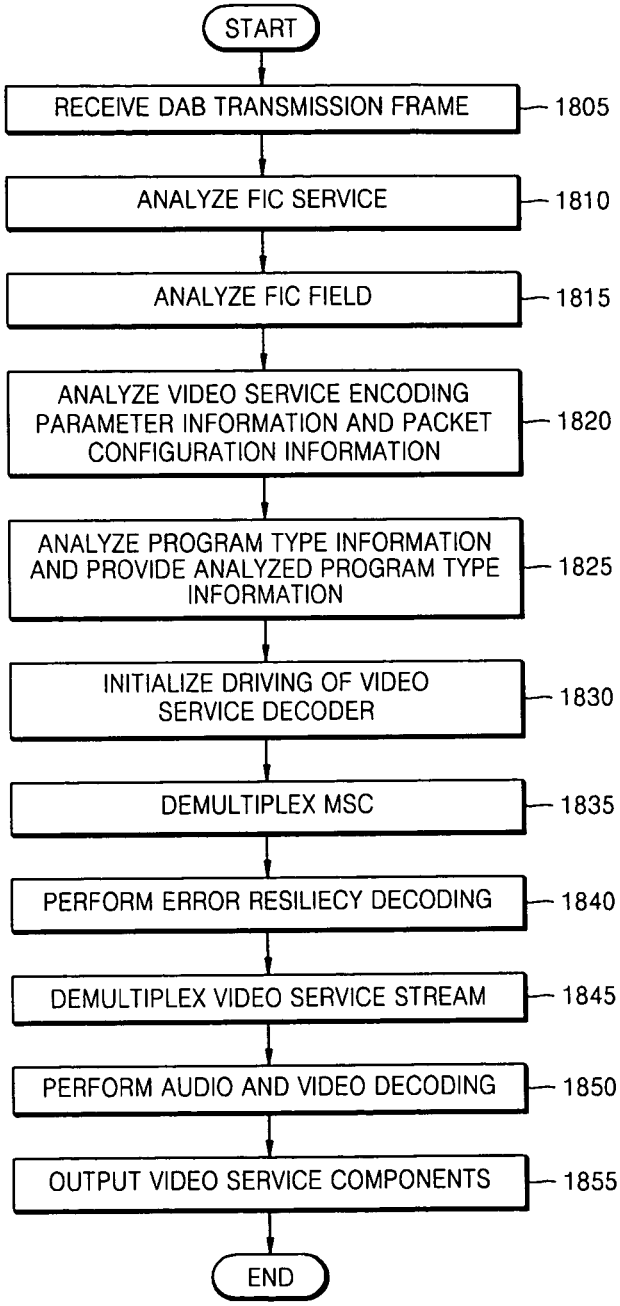
FIG. 18 is a flowchart illustrating a method of receiving a video service in a DAB receiver according to an exemplary embodiment of the present invention.

FIG. 18 is a flowchart illustrating a method of receiving a video service with reference to video service encoding information and packet configuration information in a DAB receiver according to an exemplary embodiment of the present invention.

A DAB transmission frame is received in operation S1805 and information regarding sub-channels and service components related to a service selected by a user is analyzed in operation S1810.

The FIG. 0/8 and the FIG. 0/13 in the FIC that is different from the service data channel are analyzed in operation S1815. The video service encoding parameter information and the packet configuration information required for processing the selected video service are recognized in operation S1820.

Program type information indicating the type of the provided video service is analyzed and the analyzed program type information is provided to the user in operation SI 825.

Driving of the video service decoder is initialized based on the analyzed information in operation SI 830.

The received DAB transmission frame is demultiplexed in operation S1835 and channel-decoding and error-resiliency decoding are performed on sub-channel data of the MSC in operation S1840. The video service stream is demultiplexed in operation S1845. Time synchronization information is extracted through depacketization and audio data and video data are decoded by the audio decoder and the video decoder in operation SI 850. The decoded data is output as video service components according to the extracted time synchronization information in operation SI 855.

Additional data including packet mode data, such as character information, traffic information, still images, and web information, is also decoded or depacketized by an initialized additional data decoder according to the video service encoding parameter information and the packetization information.

Figure 20:
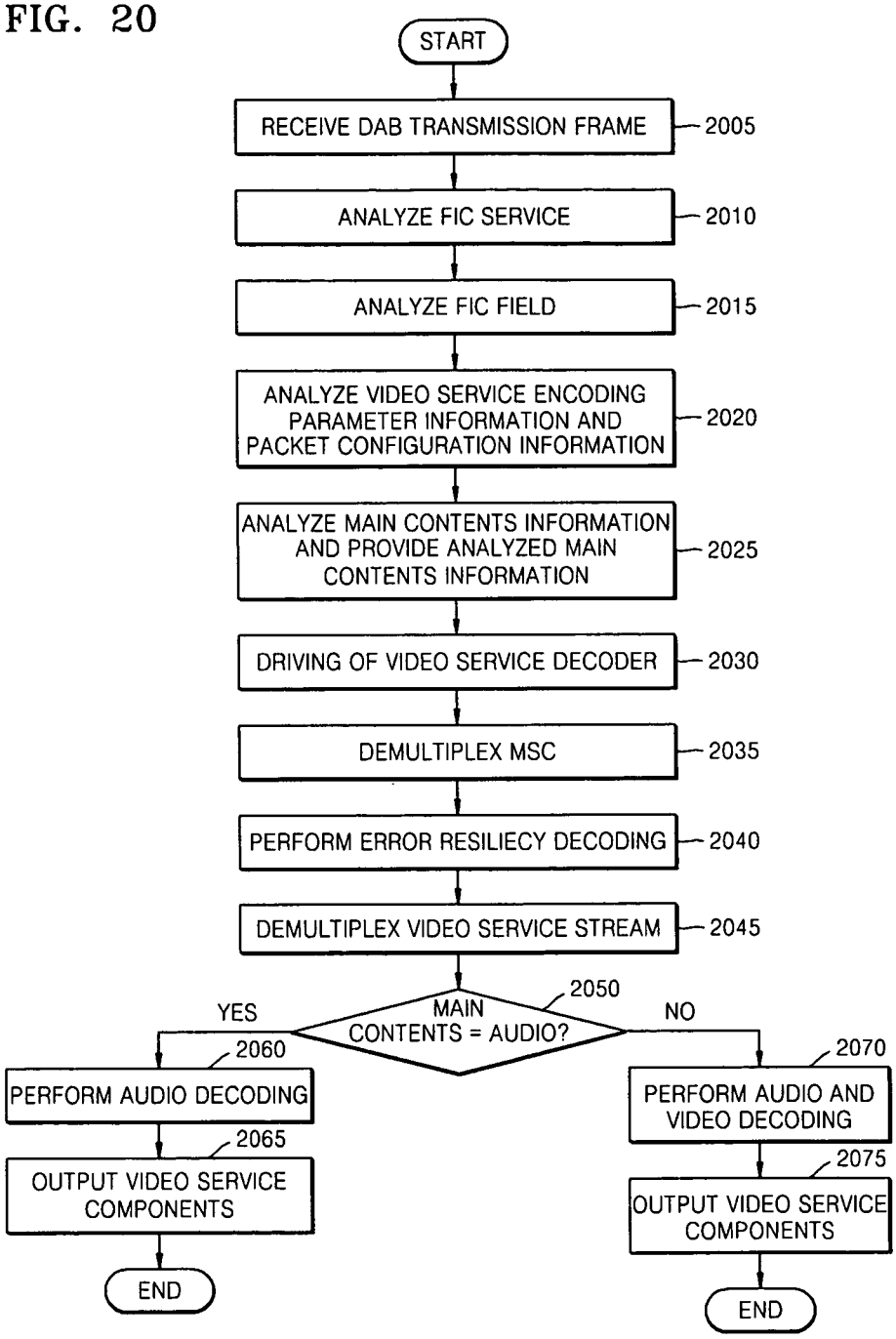
FIG. 20 is a flowchart illustrating a method of receiving a video service in a DAB receiver according to another exemplary embodiment of the present invention.

Hereinafter, another exemplary embodiment of the present invention will be described with reference to FIGS. 19 and 20. FIG. 19 illustrates a frame structure according to an exemplary embodiment of the present invention. FIG. 20 is a flowchart illustrating a method of receiving a video service in a DAB receiver according to an exemplary embodiment of the present invention.

A service having contents for audio data and video data in which the audio data is actually serviced as a main component and the video data is used as additional information may also be configured as a video service. Thus, additional broadcasting information indicating whether contents of a program of the video service use audio data or video data as the main component may be used to allow the user to selectively play the provided video service.

To this end, information indicating whether the main component of the video service is video data or audio data is included in a main contents information field following the profile ID in a user application data field as illustrated in FIG.

19. For example, the main contents information field having a value of 0 may indicate that a currently received video service is video broadcasting that uses video data as the main component. Conversely, the main contents information field having a value of 1 may indicate that the received video service is audio broadcasting that uses audio data as the main component.

Thus, even if a video service stream received by the DAB receiver includes an audio stream, a video stream, and a data stream, when broadcasting uses audio data as the main component, it is classified as audio data. Thus, only the broadcasting audio data may be decoded by an audio decoder specified by the profile ID and broadcasting video data may be selectively decoded according to a user's selection. In this way, the amount of computation for data decoding in the DAB receiver can be reduced.

Referring to FIG. 20, a DAB transmission frame is received in operation S2005, and information regarding sub-channels and service components related to a service selected by the user is analyzed in operation S2010.

The FIG. 0/8 and the FIG. 0/13 in the FIC that is different from the service data channel are analyzed in operation S2015. The video service encoding parameter information and the packet configuration information required for processing the selected video service are recognized in operation S2020.

Main contents information indicating the type of the provided video service is analyzed and the analyzed main contents information is provided to the user in operation S2025.

Driving of the video service decoder is initialized based on the analyzed information in operation S2030.

The received DAB transmission frame is demultiplexed in operation S2035. Channel-decoding and error-resiliency decoding are performed on sub-channel data of the MSC in operation S2040. The video service stream is demultiplexed in operation S2045.

In operation S2050, it is determined whether main contents information analyzed in operation S2025 indicates audio data or video data.

When the main component of the provided video service is audio data, only audio data of the provided video service is decoded by an audio decoder specified by the profile ID in operation S2060. The decoded audio data is output as components of the video service according to the extracted time synchronization information in operation S2065.

When the main component of the provided video service is video data, audio data and video are decoded in operation S2070. Next, the decoded data is output as components of the video service according to the extracted time synchronization information in operation S2075.

When the main component of the provided video service are audio data, decoding may be performed on both audio data and video data according to user's selection and the decoded data may be output as components of the video service according to the extracted time synchronization information.

As described above, according to an exemplary embodiment of the present invention, by transmitting program type information together with profile ID information over a FIC, a user of a DAB receiver can easily search for and select a program of a desired type and can be provided with a desired service.

Since information specifying a main component of a video service is transmitted over a FIC, the decoding efficiency of the DAB receiver can be improved and the user can make a selection with respect to the provided video service within a wide selection range.

Meanwhile, the method of controlling a video service including video service encoding parameter information and packetization information according to an exemplary embodiment of the present invention can also be embodied as computer program on a computer-readable recording medium. Code and code segments of the computer program can be easily construed by computer programmers in the art. The program is stored in the computer-readable recording medium, and read and executed by a computer, thereby implementing the method of controlling the video service. Examples of the computer-readable recording medium include magnetic recording media, optical recording media, and carrier waves.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of providing a video service in digital audio broadcasting (DAB), the method comprising:

inserting a profile identifier (ID) that specifies an encoding method used to encode a provided video service stream and program type information that indicates a type of the provided video service stream into a fast information channel (FIC) that is different from a service data channel comprising the video service stream; and multiplexing the service data channel and the FIC into a transmission frame for transmission, wherein the encoding method is used to compress at least one of video and audio data in the provided video service stream.

2. The method of claim 1, wherein the transmission frame is a DAB transmission frame and the video service stream comprises a video data stream or an audio data stream, or both audio and video data streams.

3. The method of claim 1, wherein the profile ID comprises information that specifies a video coding method.

4. The method of claim 1, wherein the FIC comprises fast information blocks (FIBs) of a predetermined size and a data field of each of the FIBs comprises at least one fast information group (FIG).

5. The method of claim 1, wherein the FIC comprises fast information blocks (FIBs) of a predetermined size, a data field of each of the FIBs comprises at least one fast information group (FIG), and the profile ID and the program type information are included in a single FIG.

6. A method of receiving a video service in digital audio broadcasting (DAB), the method comprising:

receiving a DAB transmission frame and analyzing an encoding method and a program type of a received encoded video service stream based on a profile identifier (ID) and program type information included in a fast information channel (FIC) of the DAB transmission frame that is received; and decoding the encoded video service stream included in a service data channel that is different from the FIC according to the encoding method and the program type that are analyzed, wherein the encoding method is used to compress at least one of video and audio data in the provided video service stream.

7. The method of claim 6, wherein the video service stream comprises a video data stream or an audio data stream, or both audio and video data streams.

8. The method of claim 6, wherein the profile ID comprises information that specifies a video coding method.

9. The method of claim 6, wherein the FIC comprises fast information blocks (FIBs) of a predetermined size and a data field of each of the FIBs comprises at least one fast information group (FIG).

10. The method of claim 6, wherein the FIC comprises fast information blocks (FIBs) of a predetermined size, a data field of each of the FIBs comprises at least one fast information group (FIG), and the profile ID and the program type information are included in a single FIG.

11. An apparatus for processing a video service in digital audio broadcasting (DAB), the apparatus comprising:

an analyzing unit that receives a DAB transmission frame and analyzes an encoding method and a program type of a received encoded video service stream based on a profile identifier (ID) and program type information included in a fast information channel (FIC) of the DAB transmission frame that is received; and a video service decoder driving unit driving a decoder that decodes the encoded video service stream included in a service data channel that is different from the FIC according to the encoding method and the program type that are analyzed, wherein the encoding method is used to compress at least one of video and audio data in the provided video service stream.

12. The apparatus of claim 11, wherein the video service stream comprises a video data stream or an audio data stream, or both audio and video data streams.

13. The apparatus of claim 11, wherein the profile ID comprises information that specifies a video coding method.

14. A transmitter for providing a video service in digital audio broadcasting (DAB), the transmitter comprising:

an encoder that encodes the video service as a provided video service stream in a service data channel according to an encoding method; and a fast information channel (FIC) processing unit which generates a profile identifier (ID) that specifies the encoding method used to encode the provided video service stream and program type information that specifies a type of the provided video service stream in an FIC, wherein the service data channel is different from the FIC and comprises the provided video service stream, which is encoded according to the encoding method that is specified by the profile ID, wherein the transmitter transmits the service data channel that comprises the video service stream and the FIC that comprises the profile ID and the program type information in a transmission data frame, wherein the encoding method is used to compress at least one of video and audio data in the provided video service stream.

15. The transmitter of claim 14, wherein the video service stream comprises a video data stream or an audio data stream, or both audio and video data streams.

16. The transmitter of claim 14, wherein the profile ID comprises information that specifies a video coding method.

17. The transmitter of claim 14, wherein the FIC comprises fast information blocks (FIBs) of a predetermined size and a data field of each of the FIBs comprises at least one fast information group (FIG).

18. The transmitter of claim 14, wherein the FIC comprises fast information blocks (FIBs) of a predetermined size, a data field of each of the FIBs comprises at least one fast information group (FIG), and the profile ID and the program type information are included in a single FIG.

19. A method of providing a video service in digital audio broadcasting (DAB), the method comprising:

inserting information that specifies a main component of a provided video service stream into a predetermined channel that is different from a service data channel that comprises the video service stream; and multiplexing the service data channel and the predetermined channel into a transmission frame for transmission, wherein the predetermined channel is a fast information channel (FIC), and a profile identifier (ID) that specifies an encoding method used for the video service stream is included in the FIC of the DAB transmission frame, wherein the encoding method is used to compress at least one of video and audio data in the provided video service stream.

20. The method of claim 19, wherein the transmission frame is a DAB transmission frame and the video service stream comprises a video data stream or an audio data stream, or both audio and video data streams.

21. The method of claim 19, wherein the information that specifies the main component of the video service stream indicates whether the main component of the video service is audio data or video data.

22. The method of claim 19, wherein the information that specifies the main component of the video service is included in the FIC of the DAB transmission frame.

23. The method of claim 22, wherein the profile ID comprises information that specifies a video coding method and an audio coding method.

24. The method of claim 22, wherein the FIC comprises fast information blocks (FIBs) of a predetermined size, a data field of each of the FIBs comprises at least one fast information group (FIG), and the information that specifies the main component of the video service stream and the profile ID that specifies the encoding method used for the video service stream are included in a single FIG.

25. The method of claim 24, wherein the FIG comprises a data service component type (DSCTy) field in which a type corresponding to an error resiliency method used in the video service is recorded.

26. A method of receiving a video service in digital audio broadcasting (DAB), the method comprising:

receiving a DAB transmission frame, and analyzing information that specifies a main component of a provided video service stream and a profile identifier (ID) that specifies an encoding method used for the video service stream, included in a predetermined channel of the DAB transmission frame that is received, which is different from a service data channel; and selectively decoding streams included in the video service stream based on the encoding method and the program type that are analyzed, wherein the encoding method is used to compress at least one of video and audio data in the provided video service stream.

27. The method of claim 26, wherein the video service stream comprises a video data stream or an audio data stream, or both audio and video data streams.

28. The method of claim 26, wherein the transmission frame is the DAB transmission frame, and information regarding encoding of the video service stream and information regarding packetization of the video service stream are received through a fast information channel (FIC) of the received DAB transmission frame.

29. The method of claim 28, wherein the FIC comprises fast information blocks (FIBs) of a predetermined size, a data field of each of the FIBs comprises at least one fast information group (FIG), and the information regarding encoding and the information regarding packetization are included in at least one FIG.

30. The method of claim 26, wherein only audio data streams among data streams included in the video service stream are decoded if the information that specifies the main component of the video service indicates that the main component of the video service is audio data.

31. The method of claim 26, wherein video data streams among data streams included in the video service stream are selectively decoded if the information that specifies the main component of the video service indicates that the main components of the video service is audio data.

32. The method of claim 26, wherein only audio data is decoded by an audio decoder specified by the profile ID if the information specifying the main component of the video service indicates that the main component of the video service is audio data.

33. An apparatus for processing a video service in digital audio broadcasting (DAB), the apparatus comprising:

an analyzing unit that receives a DAB transmission frame and analyzes information that indicates a main component of a provided video service stream and a profile identifier (ID) that specifies an encoding method used for the video service stream included in a predetermined channel of the DAB transmission frame that is received, which is different from a service data channel; and a video service decoder driving unit driving a decoder that selectively decodes streams included in the video service stream according to the encoding method and the program type that are analyzed, wherein the encoding method is used to compress at least one of video and audio data in the provided video service stream.

34. The apparatus of claim 33, wherein the video service stream comprises a video data stream or an audio data stream, or both audio and video data streams.

35. The apparatus of claim 33, wherein information regarding encoding of the video service stream and information regarding packetization of the video service stream are received through a fast information channel (FIC) of the DAB transmission frame that is received.

36. A transmitter for providing a video service in digital audio broadcasting (DAB), the transmitter comprising:

a fast information channel (FIC) processing unit that generates information that specifies a main component of a provided video service stream in an FIC; and a service data channel processing unit that processes the provided video service stream in a service data channel, wherein the transmitter transmits the service data channel that comprises the video service stream and the FIC that comprises the profile ID that specifies an encoding method used for the video service stream and the program type information in a transmission data frame, wherein the encoding method is used to compress at least one of video and audio data in the provided video service stream.

37. The transmitter of claim 36, wherein the video service stream comprises a video data stream or an audio data stream, or both audio and video data streams.

38. The transmitter of claim 36, wherein the FIC further comprises a profile identifier (ID) that specifies an encoding method of encoding the provided video service stream.

39. A non-transitory computer-readable recording medium having recorded thereon a program for executing a method of providing a video service in digital audio broadcasting (DAB), the method comprising:

inserting a profile identifier (ID) that specifies an encoding method used to encode a provided video service stream and program type information that indicates a type of the provided video service stream into a fast information channel (FIC) that is different from a service data channel comprising the video service stream; and multiplexing the service data channel and the FIC into a transmission frame for transmission, wherein the encoding method is used to compress at least one of video and audio data in the provided video service stream.

40. A non-transitory computer-readable recording medium having recorded thereon a program for executing a method of receiving a video service in digital audio broadcasting (DAB), the method comprising:

receiving a DAB transmission frame and analyzing an encoding method and a program type of a received encoded video service stream based on a profile identifier (ID) and program type information included in a fast information channel (FIC) of the DAB transmission frame that is received; and decoding the encoded video service stream included in a service data channel that is different from the FIC according to the encoding method and the program type that are analyzed, wherein the encoding method is used to compress at least one of video and audio data in the provided video service stream.

41. A non-transitory computer-readable recording medium having recorded thereon a program for executing a method of providing a video service in digital audio broadcasting (DAB), the method comprising:

inserting information that specifies a main component of a provided video service stream into a predetermined channel that is different from a service data channel that comprises the video service stream; and multiplexing the service data channel and the predetermined channel into a transmission frame for transmission, wherein the encoding method is used to compress at least one of video and audio data in the provided video service stream.

42. A non-transitory computer-readable recording medium having recorded thereon a program for executing a method of receiving a video service in digital audio broadcasting (DAB), the method comprising:

receiving a DAB transmission frame, and analyzing information that specifies a main component of a provided video service stream, included in a predetermined channel of the DAB transmission frame that is received, which is different from a service data channel; and selectively decoding streams included in the video service stream based on the encoding method and the program type that are analyzed, wherein the encoding method is used to compress at least one of video and audio data in the provided video service stream.

* * * * *